United States Patent [19]

LeRoy

[11] 4,093,780

[45] June 6, 1978

[54] TREATMENT OF ZINC SURFACES TO INHIBIT WET STORAGE STAINING AND PRODUCTS EMPLOYED THEREIN

[75] Inventor: Rodney Lash LeRoy, Pointe Claire, Canada

[73] Assignee: Noranda Mines Limited, Quebec, Canada

[21] Appl. No.: 633,100

[22] Filed: Nov. 17, 1975

Related U.S. Application Data

[62] Division of Ser. No. 386,628, Aug. 8, 1973, abandoned.

[30] Foreign Application Priority Data

Aug. 21, 1972 Canada ..... 149910

[51] Int. Cl.[2] ..... B32B 15/08; B05D 3/00

[52] U.S. Cl. ..... 428/458; 428/543; 427/327; 427/354; 427/421; 427/429; 427/428; 427/435; 148/6.24; 21/2.7 R; 106/14.13

[58] Field of Search ..... 427/354, 421, 429, 428, 427/435, 327; 252/395; 148/6.24; 21/27 R; 106/14; 428/463, 411, 543, 458

[56] References Cited

U.S. PATENT DOCUMENTS

| | | | |
|---|---|---|---|
| 2,859,146 | 11/1958 | Prust | 427/435 X |
| 2,926,108 | 2/1960 | Andersen | 427/435 X |
| 3,022,200 | 2/1962 | Koerner et al. | 427/435 X |
| 3,078,555 | 2/1963 | McFarland | 427/429 X |
| 3,282,848 | 11/1966 | Haslam | 252/395 X |
| 3,330,672 | 7/1967 | Kroll et al. | 252/395 X |
| 3,494,806 | 2/1970 | Teumac | 427/421 |
| 3,565,678 | 2/1971 | Johnson et al. | 427/421 |

*Primary Examiner*—P. C. Ives

*Attorney, Agent, or Firm*—Finnegan, Henderson, Farabow & Garrett

[57] ABSTRACT

It has been found that esters and polyesters of thioglycolic acid, which form a protective, water insoluble complex with zinc atoms, are suitable for inhibiting wet storage staining and the formation of white rust in zinc and zinc coated materials. Many of these compounds are new products.

18 Claims, No Drawings

TREATMENT OF ZINC SURFACES TO INHIBIT WET STORAGE STAINING AND PRODUCTS EMPLOYED THEREIN

This is a division of application Ser. No. 386,628, filed 8/8/73, now abandoned.

This invention relates to a treatment of zinc surfaces to inhibit wet storage staining or the formation of "white rust". More particularly, the invention refers to a new class of compounds for achieving the above effect; some of these compounds are new products which have been synthesized by the applicant and which form part of the present invention. The invention also includes compositions containing these compounds and methods of treatment of zinc surfaces therewith to provide protection against wet storage staining of zinc and to avoid or substantially reduce "white rust" formation.

It is well known that surfaces of zinc and metallic materials coated with zinc, such as galvanized steel, are subject to the so-called "wet storage staining". This means that during storage and transportation in humid environments the sheets or articles made of zinc or coated with zinc become oxidized and form powdery surface stains which are commonly known as "white rust". The presence of "white rust" greatly impairs the appearance of the articles and also the adhesion of paints or other coatings which one may wish to apply to the metal.

In view of ever increasing demand for galvanized steel products, this problem of wet storage staining has become very acute in the steel industry and although many methods and compositions for treating galvanized steel and/or zinc surfaces to prevent wet storage staining and inhibit the formation of "white rust" have been suggested in the past, none has been found entirely satisfactory.

The great majority of known "white rust" inhibitors are based on inorganic compounds, such as chromic acid, chromic anhydride or various chromates in combination with other substances such as silicates, phosphates, fluorides and the like. One of the best known "white rust" inhibiting products is sold under the trade mark "Iridite". This product contains hexavalent chromium, a fluoride and ammonia, together with silicic acid and a wetting agent. However, treatments of zinc surfaces with such known products have not proved entirely satisfactory and in most cases they have added significantly to the cost of the articles.

It has now been surprisingly found that certain organic compounds, namely esters and polyesters of thioglycolic acid, are eminently suitable for inhibiting wet storage staining of zinc and zinc coated materials because they form a water insoluble protective coating with zinc on the metal surface.

Basically, all esters and polyesters of thioglycolic acid which form a water-insoluble complex with zinc atoms are suitable as inhibiting agents in accordance with the present invention. By water-insoluble, it is meant that the complex should have a solubility in water below 0.1 g per liter at 20° C. Preferably, the water solubility of the complex should be below 1 mg. per liter at 20° C.

A man of the art will be able to establish the presence of the zinc-thioglycolate or zinc-polythioglycolate complex and to determine its solubility in water by conventional chemical and analytical techniques.

The active organic compounds of the present invention, which are generally inexpensive and easy to produce, can be applied onto the zinc surface in the form of a solution in any suitable solvent, such as water, alcohol, ketones, petroleum solvents and the like, and the application can be carried out by dipping, spraying, brushing, rubbing or any other suitable method. They can also be applied in the form of dispersions or even as compositions which contain up to 99% of the active compound, with a very small amount of water or other solvent being added thereto to promote formation of the complex. Thus, the inhibiting composition according to this invention may comprise between 0.01% and 99% by weight of the active compound (namely of the ester or polyester of thioglycolic acid), the remainder being a suitable solvent, diluent or carrier. Generally, however, solutions or dispersions containing between 0.05 and 30% by weight of the active compound will be used. Most commonly, solutions or dispersions containing between 0.15% and 3% by weight of the active compound are preferred because they provide satisfactory protection and at the same time are inexpensive due to the small concentration of the active compound therein. Particularly preferred are aqueous solutions or dispersions, again because of their low cost.

Examples of suitable active compounds which have been found, in accordance with the present invention, to be effective wet stain inhibitors for zinc surfaces are:

alkyl thioglycolates of the general formula $HSCH_2C(O)OC_nH_{2n+1}$ wherein $n$ is between 3 and 18 inclusive
butanediol dithioglycolate
butanetriol trithioglycolate
decanediol dithioglycolate
1,3-dihydroxypropanone dithioglycolate
dipentaerythritol dithioglycolate
dipentaerythritol trithioglycolate
dipentaerythritol tetrathioglycolate
dipentaerythritol hexathioglycolate
dipropyleneglycol dithioglycolate
glycerol dithioglycolate
glycerol trithioglycolate
heptanediol dithioglycolate
hexanediol dithioglycolate
hexanetriol dithioglycolate
hexanetriol trithioglycolate
inositol dithioglycolate
inositol trithioglycolate
nonanediol dithioglycolate
octanediol dithioglycolate
pentaerythritol tetrathioglycolate
pentaerythritol trithioglycolate
pentanediol dithioglycolate
propanediol dithioglycolate
sorbitol trithioglycolate
trimethylolethane dithioglycolate
trimethylolethane trithioglycolate.

It should further be noted that isomeric forms of the various compounds are also satisfactory for the purposes of the present invention provided, of course, they can form a water insoluble complex with zinc atoms. Basically, such isomeric forms should satisfy the following requirements:

(a) the $—OC(O)CH_2SH$ group or groups should not be altered, and (b) the number of ether linkages should not be changed.

Examples of isomers which were tested and found effective for the purposes of this invention are:
1,4-butanediol dithioglycolate
1,2,4-butanetriol trithioglycolate
1,10-decanediol dithioglycolate
2,2-diethyl-1,3-propanediol dithioglycolate
1,6-hexanediol dithioglycolate
2,5-hexanediol dithioglycolate
2-methyl-2,4-pentanediol dithioglycolate
1,2,6-hexanetriol dithioglycolate
1,2,6-hexanetriol trithioglycolate
trimethylolpropane trithioglycolate
2-n-butyl-2-ethyl-1,3-propanediol dithioglycolate
2-ethyl-1,3-hexanediol dithioglycolate
1,5-pentanediol dithioglycolate
1,2-propanediol dithioglycolate
1,3-propanediol dithioglycolate.

Several of these compounds are available commercially although they have never been used for the treatment of zinc surfaces. Thus, the alkyl thioglycolates are available commercially, trimethylolpropane trithioglycolate is available commercially as well as compounds such as pentaerythritol tetrathioglycolate and trimethylolethane trithioglycolate. Several of these compounds are also known from prior art, these are, for example, 1,4-butanediol dithioglycolate; glycerol dithioglycolate; glycerol trithioglycolate; 1,6-hexanediol dithioglycolate and 1,2-propanediol dithioglycolate.

On the other hand, the applicant has synthesized a number of polythioglycolate compounds which are believed to be new since they were not found described in any prior art literature. A search in Chemical Abstracts from January 1947 to the present as well as a patent search have not revealed the existence of the following new polythioglycolate compounds:
1,2,4-butanetriol trithlorglvcolate
1,10-decanediol dithioglycolate
1,3-dihydroxypropanone dithioglycolate
dipentaerythritol dithioglycolate
dipentaerythritol trithioglycolate
dipentaerythritol tetrathioglycolate
dipentaerythritol hexathioglycolate
dipropyleneglycol dithioglycolate
2,2-diethyl-1,3-propanediol dithioglycolate
2,5-hexanediol dithioglycolate
2-methyl-2,4-pentanediol dithioglycolate
1,2,6-hexanetriol dithioglycolate
1,2,6-hexanetriol trithioglycolate
inositol dithioglycolate
inositol trithioglycolate
2-n-butyl-2-ethyl-1,3-propanediol dithioglycolate
2-ethyl-1,3-hexanediol dithioglycolate
pentaerythritol trithioglycolate
1,5-pentanediol dithioglycolate
1,3-propanediol dithioglycolate
sorbitol trithioglycolate
trimethylolethane dithioglycolate.

It is believed that all these compounds have, for the first time, been synthesized by the applicant.

Although all esters and polyesters of thioglycolic acid which can form a water insoluble complex with zinc atoms will inhibit wet storage staining and the formation of "white rust" on zinc surfaces, it has been found that the particularly preferred compound which produces exceptional results is 1,2,6-hexanetriol trithioglycolate of the following structural formula:

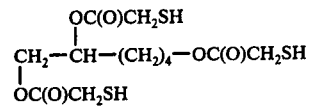

This is believed to be the best inhibitor within the scope of the present invention and it is also believed to be a new compound per se. It should be noted, however, that it is by no means the only inhibitor that produces satisfactory results. Many other compounds, particularly from the group identified above, have been found to possess excellent inhibiting and protective properties in accordance with this invention.

The synthesis of the various polythioglycolate compounds may be carried out in conventional and well known manner and does not present any special difficulty. Thus, the esterification of thioglycolic acid with various polyols may be achieved in a three-neck flask provided with a magnetic stirrer for continuous stirring throughout the reaction period, a heating mantle, a thermometer, and a water cooled reflux condenser attached through a water trip for water removal. The esterification is carried out in the presence of a refluxing agent such as toluene or xylene, which serves to remove the water of condensation into the water trap. The amount of this refluxing agent may be decreased or increased as needed to hold the refluxing mixture at a predetermined temperature.

Occasionally, polythioglycolate compounds prepared as described above become discoloured as the reaction approaches completion. It was found that this discolouration could be avoided by carrying out the reaction in a nitrogen atmosphere. Catalysts, such as p-toluenesulfonic acid, may also be used in these syntheses.

Specific examples of synthesis of some of the polythioglycolate compounds are given herebelow:

EXAMPLE 1

Synthesis of 1,2,6Hexanetriol Trithioglycolate

A reaction mixture of 72 g. of 1,2,6-hexanetriol, 150 g. of thioglycolic acid and 40 g. of xylene was refluxed in a nitrogen atmosphere for 2 hrs. at 125°-155° C, and 2 hrs. at 155°-160° C. 29.0 g. of water of condensation were collected, compared to an expected 29.5 g. The mixture was freed of solvent, water, and unreacted materials by stripping to a pot temperature of 155° C at 2 torr pressure. The residual product was a clear liquid and weighed 217 g. compared to an expected 222 g.

EXAMPLE 2

Synthesis of Glycerol Dithioglycolate

A reaction mixture of 20 g. of glycerol, 40 g. of thioglycolic acid, 0.3 g. of p-toluenesulfonic acid, and 30 g. of toluene was refluxed in a nitrogen atmosphere, for 1 hr. at 108°-117° C and 1 hr. at 117° C to 120° C. 7.6 g. of water of condensation were collected, compared to an expected 7.8 g. The reaction mixture was stripped to a pot temperature of 120° C at 5 torr. The residual product was a clear and colourless liquid.

EXAMPLE 3

Synthesis of Inositol Dithioglycolate

A reaction mixture of 32.7 g. of inositol, 33,3 g. of thioglycolic acid and 35 g. of xylene were refluxed in a nitrogen atmosphere for 3 hrs. at 140°–150° C and 2 hrs. at 150°–155° C. 7.4 g. of water of condensation were collected, compared to an expected 6.5 g. The mixture was stripped to a pot temperature of 150° C at 2 torr. When cooled to room temperature, the product was a hard, light yellow solid.

EXAMPLE 4

Synthesis of Inositol Trithioglycolate

A reaction mixture of 23.7 g. of inositol, 36.3 g. of thioglycolic acid and 30 g. of xylene were refluxed for 2 hrs. at 140°–150° C and for 2 hrs. at 150°–155° C. 8.4 g. of water of condensation were collected compared to an expected 7.1 g. The mixture was stripped to a pot temperature of 150° C at 2 torr, leaving a product which, when cooled to room temperature, became a hard yellow solid.

All other polythioglycolates which were not available commercially, were synthesized by the applicant in accordance with Example 1 mentioned above, using the appropriate mole ratios of polyol and thioglycolic acid. In each case, the water obtained was within 5–10% of the calculated value. In view of the fact that the procedure is entirely conventional and reproducible, it is not believed necessary to give additional specific synthesis examples of the various compounds since from the details given above any man of the art will be able to synthesize all these products including the new polythioglycolate compounds mentioned above.

The following additional examples illustrate the application of the various compounds as inhibitors of wet storage staining and "white rust" on zinc and galvanized surfaces.

EXAMPLE 5

Galvanized coupons were treated by dipping in an 0.15% aqueous dispersion of n-butyl thioglycolate at 55° C. On exposure to water, coupons treated in this way resisted visible evidence of "white rust" formation for more than 50 times as long as untreated coupons.

EXAMPLE 6

Galvanized panels (4 in. × 8 in.) were treated by dipping in a 1.5% methyl hydrate solution of 1,2,6-hexanetriol trithioglycolate. After exposure on a humidity cabinet (100° F, 100% R.H.) these panels suffered less damage than similar panels treated with the chromate based formulation known under the trade mark "Iridite".

EXAMPLE 7

Galvanized panels (4 in. × 8 in.) were treated by dipping in an 0.15% aqueous dispersion of 1,2,6-hexanetriol trithioglycolate at 55° C. The panels were sprayed with distilled water, and clamped together in a stack, which was exposed out-of-doors. Iridite-treated and untreated panels were included in the stack. After 10 days' exposure, untreated panels were heavily stained with "white rust" and Iridite-treated panels had 20–30% "white rust" damage on their surfaces and were dulled. Panels treated with 1,2,6-hexanetriol trithioglycolate solution had no evidence of "white rust" damage.

EXAMPLE 8

Galvanized panels (4 in. × 8 in.) were treated by dipping in a well-stirred 0.3% aqueous dispersion of 1,2,6-hexanetriol trithioglycolate at 55° C, passed through hard rubber rollers, and hot air dried. Exposed on a humidity cabinet, the panels had not developed visible "white rust" damage after 20 days. Iridite-treated panels developed heavy "white rust" after being exposed for the same period. Untreated panels are heavily corroded after being exposed for one hour in this test.

EXAMPLE 9

Galvanized coupons (2 in. × 2 in.) were treated by dipping in an 0.6%, 25° C methyl iso-butyl ketone solution of 1,2,6-hexanetriol trithioglycolate. On exposure to water, these coupons resisted visible evidence of corrosion damage for more than 30 hours. Further coupons, treated in the same way, were exposed in a water film test (samples were wetted with water and stacked between glass plates). In this test, treated coupons showed 5–10% "white rust" damage after 6 days, while untreated coupons had 100% heavy "white rust" damage after 6 hours.

EXAMPLE 10

Zinc coupons (3 in. × 2 in.) were treated by dipping in a 0.3%, 55° C aqueous dispersion of 1,2,6-hexanetriol trithioglycolate. Treated and untreated zinc coupons were exposed by partial immersion in water. The untreated coupons developed heavy "white rust" in 1 hour, while 1,2,6-hexanetriol trithioglycolate treated coupons were still free of visible damage after 50 hours exposure.

EXAMPLE 11

1,2,6-Hexanetriol trithioglycolate containing between 1% and 5% of water was rubbed into both sides of 4 in. × 4 in. galvanized steel panels, using a soft cloth. After 36 hours exposure in the water film test such as mentioned in example 9, these panels were free of visible "white rust".

EXAMPLE 12

Galvanized steel panels (4 in. × 8 in.) were treated by dipping in a 0.5%, 55° C aqueous dispersion of 2-methyl-2,4-pentanediol dithioglycolate, followed by rolling between hard rubber rollers, rinsing in cold water, and air drying. Exposed on a humidity cabinet, these panels resisted serious damage (i.e. less than 10% visible damage on the exposed surface) for 250 hours, more than 250 times as long as untreated panels.

EXAMPLE 13

Galvanized steel coupons (2 in. × 2 in.) were treated by dipping in a 1.5%, 50° C, methyl hydrate solution of glycerol trithioglycolate, followed by rinsing with cold water. Treated coupons resisted visible corrosion damage for 36 hours on exposure by partial immersion in water.

EXAMPLE 14

Galvanized steel coupons (2 in. × 2 in.) were treated by dipping in a 1.5%, 50° C methyl hydrate solution of glycerol dithioglycolate, followed by rinsing with cold water. Treated coupons resisted visible corrosion damage for 74 hours on exposure by partial immersion in water.

EXAMPLE 15

Galvanized steel coupons (2 in. × 2 in.) were treated by dipping in a 0.15%, 55° C, aqueous dispersion of sorbitol trithioglycolate, followed by rinsing in cold water. These coupons were tested by partial immersion in water and found to resist visible corrosion damage for 20 hours, more than 50 times as long as untreated coupons.

The use of the compounds of the present invention in many instances also has an important economic advantage. These compounds are produced in a simple and efficient manner and their cost is generally low.

It is also well known that galvanized steel, and in particular galvanized steel treated with inorganic white rust inhibiting agents such as "Iridite", is notorious for its poor paintability. On the other hand, galvanized steel treated with the thioglycolates or polythioglycolates in accordance with the present invention provides an organic layer bonded to the zinc surface, which is much more compatible with common paint formulations. Thus, the zinc surfaces or galvanized steel surfaces treated, for example, with 1,2,6-hexanetriol trithioglycolate, provide a superior substrate for any single coat organic paint and a much better paint adhesion than the "Iridate"-treated surfaces.

What is claimed is:

1. Zinc or galvanized articles having a wet storage staining and white rust inhibiting surface coating consisting essentially of a protective water-insoluble zinc-thioglycolate or zinc-polythioglycolate complex.

2. Zinc or galvanized articles according to claim 1, wherein the surface coating consists of a protective zinc-1,2,6-hexanetriol trithioglycolate complex.

3. Zinc or galvanized articles according to claim 1 wherein said protective complex is a complex of zinc with alkyl thioglycolates of the general formula:

$$HSCH_2(O)OC_nH_{2n}+1$$

wherein $n$ is between 3 and 18 inclusive.

4. Zinc or galvanized articles according to claim 1 wherein said protective compound is a complex of zinc with a polythioglycolate which is selected from the following polythioglycolates:

butanediol dithioglycolate
butanetriol trithioglycolate
decanediol dithioglycolate
1,3-dihydroxypropanone dithioglycolate
dipentaerythritol dithioglycolate
dipentaerythritol trithioglycolate
dipentaerythritol tetrathioglycolate
dipentaerythritol hexathioglycolate
dipropyleneglycol dithioglycolate
glycerol dithioglycolate
glycerol trithioglycolate
heptanediol dithioglycolate
hexanediol dithioglycolate
hexanetriol dithioglycolate
hexanetriol trithioglycolate
inositol dithioglycolate
inositol trithioglycolate
nonanediol dithioglycolate
octanediol dithioglycolate
pentaerythritol tetrathioglycolate
pentaerythritol trithioglycolate
pentanediol dithioglycolate
propanediol dithioglycolate
sorbitol trithioglycolate
trimethylolethane dithioglycolate
trimethylolethane trithioglycolate
and isomers thereof in which the —-$OC(O)CH_2SH$ groups are not altered and the number of ether linkages is not changed.

5. Zinc or galvanized articles according to claim 1 wherein said protective compound is a complex of zinc with a polythioglycolate which is selected from the following polythioglycolates:

1,4-butanediol dithioglycolate
1,2,4-butanetriol trithioglycolate
1,10-decanediol dithioglycolate
2,2-diethyl-1,3-propanediol dithioglycolate
1,6-hexanediol dithioglycolate
2,5-hexanediol dithioglycolate
2-methyl-2,4-pentanediol dithioglycolate
1,2,6-hexanetriol dithioglycolate
trimethylolpropane trithioglycolate
2-n-butyl-2-ethyl-1,3-propanediol dithioglycolate
2-ethyl-1,3-hexanediol dithioglycolate
1,5-pentanediol dithioglycolate
1,2-propanediol dithioglycolate
1,3-propanediol dithioglycolate.

6. A method for inhibiting wet storage staining and formation of white rust on zinc surfaces which comprises treating said surfaces with an inhibiting composition, which composition comprises 0.01% to 99% by weight, as active compound, of an ester of polyester of thioglycolic acid for producing a protective, water insoluble complex zinc-thioglycolate or zinc-polythioglycolate on the zinc surface.

7. Method according to claim 6, wherein the treatment is carried out by dipping the zinc surface into the inhibiting composition.

8. Method according to claim 6, wherein the treatment is carried out by spraying, brushing or rubbing the zinc surface with said composition.

9. Method according to claim 6, wherein said treatment is carried out on galvanized steel products.

10. Method according to claim 6, wherein said treatment is followed by rinsing of the treated surface with water.

11. Method according to claim 6, wherein said treatment is carried out on strip or sheet products and is followed by rolling of the treatment product between a pair of rollers, rinsing in water and drying.

12. A method according to claim 6 wherein said active compound is selected from the group of alkyl thioglycolates of the general formula:

$$HSCH_2C(O)OC_nH_2n+1$$

wherein $n$ is between 3 and 18 inclusive.

13. A method according to claim 6 wherein said active compound is selected from the following polythioglycolates:

butanediol dithioglycolate
butanetriol trithioglycolate
decanediol dithioglycolate
1,3-dihydroxypropanone dithioglycolate
dipentaerythritol dithioglycolate
dipentaerythritol trithioglycolate
dipentaerythritol tetrathioglycolate
dipentaerythritol hexathioglycolate
dipropyleneglycol dithioglycolate
glycerol dithioglycolate
glycerol trithioglycolate heptanediol dithioglycolate
hexanediol dithioglycolate
hexanetriol dithioglycolate
hexanetriol trithioglycolate
inositol dithioglycolate
inositol trithioglycolate
nonanediol dithioglycolate
octanediol dithioglycolate
pentaerythritol tetrathioglycolate
pentaerythritol trithioglycolate
pentanediol dithioglycolate
propanediol dithioglycolate
sorbitol trithioglycolate
trimethylolethane dithioglycolate
trimethylolethane trithioglycolate and isomers thereof in which the $—OC(O)CH_2SH$ groups are not altered and the number of ether linkages is not changed.

14. A method according to claim 6 wherein said active compound is selected from the following polythioglycolates:

1,4-butanediol dithioglycolate
1,2,4-butanetriol trithioglycolate
1,10-decanediol dithioglycolate
2,2-diethyl-1,3-propanediol dithioglycolate
1,6-hexanediol dithioglycolate
2,5-hexanediol dithioglycolate
2-methyl-2,4-pentanediol dithioglycolate
1,2,6-hexanetriol dithioglycolate
trimethylolpropane trithioglycolate
2-n-butyl-2-ethyl-1,3-propanediol dithioglycolate
2-ethyl-1,3-hexanediol dithioglycolate
1,5-pentanediol dithioglycolate
1,2-propanediol dithioglycolate
1,3-propanediol dithioglycolate.

15. Method according to claim 6, wherein the inhibiting composition with which the zinc surface is treated is a solution comprising between about 0.15% and 3% of the ester or polyester of thioglycolic acid capable of forming a water insoluble complex with zinc, dissolved in a solvent.

16. Method according to claim 15, wherein said inhibiting composition is a solution of 1,2,6-hexanetriol trithioglycolate in a solvent.

17. Method according to claim 15, wherein said solvent is water.

18. Method according to claim 15, wherein said solvent is selected from alcohols, ketones and petroleum solvents.

* * * * *